United States Patent [19]

Huffnagle et al.

[11] 4,089,580

[45] May 16, 1978

[54] MULTI-CONTACT CONNECTOR AND CONTACT TERMINAL FOR FLAT CABLE HAVING A PLURALITY OF CONDUCTORS ON CLOSE CENTER LINES

[75] Inventors: Clifton Wesley Huffnagle, Camp Hill; James Paul Ward, Harrisburg, both of Pa.

[73] Assignee: AMP Incorporated, Harrisburg, Pa.

[21] Appl. No.: 772,171

[22] Filed: Feb. 25, 1977

[51] Int. Cl.[2] ..... H01R 13/38

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 3,027,536 | 3/1962 | Pasternak | 339/97 R |
| 3,816,818 | 6/1974 | Meier | 339/99 R |
| 3,820,055 | 6/1974 | Huffnagle et al. | 339/97 P |
| 3,854,114 | 12/1974 | Kloth et al. | 339/97 R |

*Primary Examiner*—Joseph H. McGlynn
*Attorney, Agent, or Firm*—Russell J. Egan

[57] ABSTRACT

An insulation displacing contact and connector are disclosed for effecting electrical engagement with closely spaced conductors of a multi-conductor flat flexible cable. The elements of the contact include a plurality of parallel tines spaced along a plane defined by the axis of the conductor and defining therebetween at least two insulation displacing slots which form a tortuous path for the conductor. Latching means may be provided on the free end of at least one tine to engage and secure a cover to a contact carrying connector base.

8 Claims, 7 Drawing Figures

MULTI-CONTACT CONNECTOR AND CONTACT TERMINAL FOR FLAT CABLE HAVING A PLURALITY OF CONDUCTORS ON CLOSE CENTER LINES

BACKGROUND OF THE INVENTION

1. The Field Of The Invention

The present invention relates to a method and apparatus for effecting electrical termination of multi-conductor cable wherein the conductors lie on very close center lines.

2. The Prior Art

It is generally known to use electrical connectors for flat cables having a wire-in-slot type contact terminals therein which puncture the insulation of the cable in a manner such that each conductor of the cable is moved into the slot of one of the contact terminals to make electrical and mechanical engagement therewith. U.S. Pat. Nos. 3,189,863; 3,444,506; 3,225,833; and 3,820,055 are representative of the known prior art. U.S. Pat. No. 3,820,055 assured the securing of the cable in the connector by including a latching portion on the terminals so that the cover of the connector is secured against the cable in the terminated condition. Continuing developments in the electrical industry have called for closer and closer center lines of the conductors in the cable so that many of the contacts of the above-discussed prior art are no longer suitable since the width of the contacts can exceed the spacing between the conductors. A first attempt made to realign the contacts is shown in U.S. Pat. No. 3,930,708 with the contacts extending in the direction of the axis of the conductor rather than transverse to this axis.

The present invention represents an improvement in all of the above-discussed prior art and yet enables accurate termination of the conductors of a multi-conductor flat flexible cable in which the conductors are on closely spaced centers.

SUMMARY OF THE INVENTION

The present invention includes connector assembly and contact terminal for effecting termination of multi-conductor cable in which the conductors are aligned on closely spaced centers. The connector comprises a housing, a cover, and a plurality of insulation displacing contacts acting along the axis of the conductors. Each contact terminal has at least a trident configuration on the conductor engaging end thereof. This configuration includes at least three arm portions respectively defining therebetween at least two wire engaging slots which form a tortuous path for the conductor. In an alternate embodiment, the contact terminal is modified to include latch means on the free end of at least one of the arm portions. This latch means engages with the cover to secure it against the housing. the contact terminal can further be provided with latching means to secure it in the housing and with a matable portion of substantially any configuration adopted so engage a further electrical connector.

It is therefore an object of the present invention to produce an improved electrical connector assembly for effecting an insulation displacing engagement of conductors located on close center lines in multi-conductor flat flexible cable.

It is another object of the present invention to produce an electrical contact terminal which will effect electrical engagement a conductor of a cable having a plurality of conductors on close center lines.

It is a further object of the present invention to produce an electrical connector assembly for effecting termination of closely spaced conductors of a multi-conductor flat flexible cable, which connector can be readily and economically manufactured.

The means for accomplishing the foregoing objects and other advantages will become apparent to those skilled in the art from the following detailed description of the invention taken with reference to the accompanying drawings.

DETAILED DESCRIPTION OF THE PREFERRED EMBODIMENT

The subject connector is used in connection with known flat multi-conductor cable 10 which includes a plurality of conductors 12 held in fixed, close, parallel spaced relation in an insulating web 14. Such cable is conventionally manufactured either by an extrusion of the insulation material on the spaced conductors or by laminating webs of insulation on both sides of the conductors. The present invention is particularly successful at terminating cable having conductors on close center lines, for example 0.050 inch or less.

Figure 3:
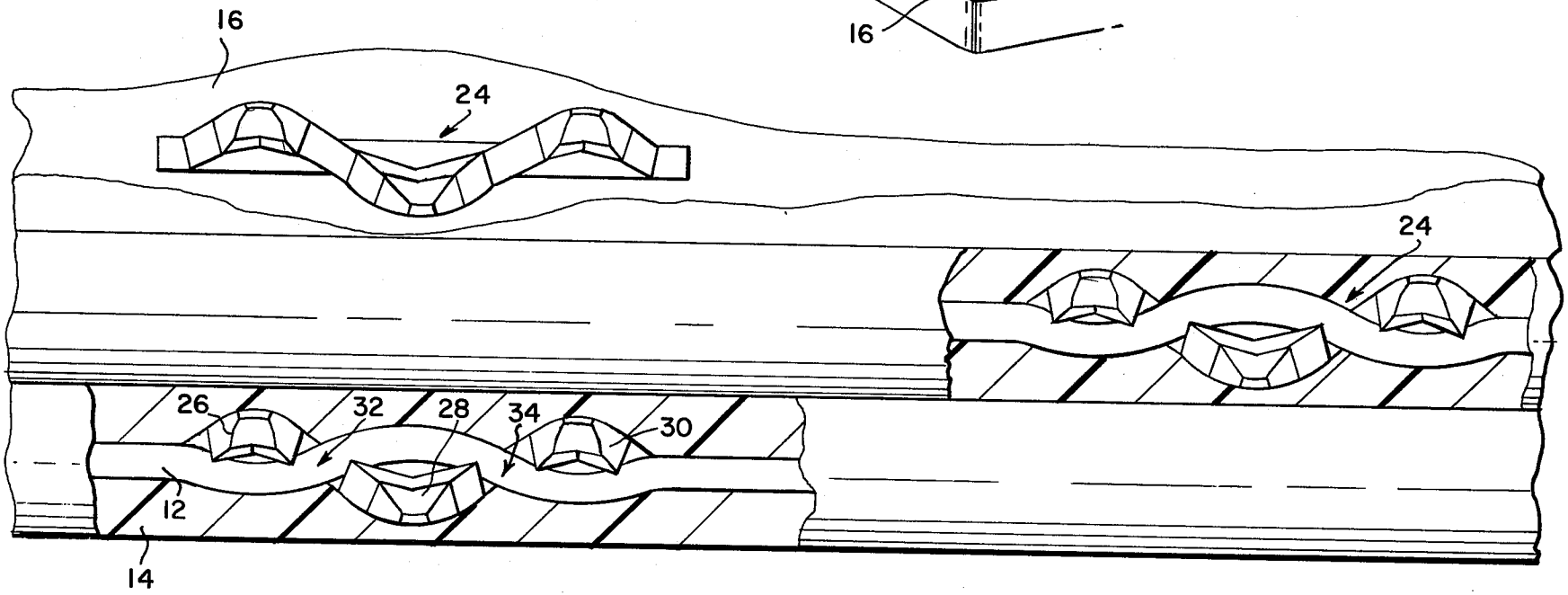
FIG. 3 is a top plan view showing contact terminals of the present invention terminating a segment of a multi-conductor flat flexible cable.

The subject connector includes a contact block 16, a plurality of contacts 18 mounted in the block, and a cover 20 for assembly with the block 16. The block includes a plurality of contact receiving passages 22 extending therethrough. Each contact 18 includes a conductor engaging end 24 defined by a trident configuration of at least three arms 26, 28, 30. The arms define therebetween a pair of parallel spaced slots 32, 34. Each of the contact arms 26, 28, 30 has a concave configuration, as best seen in FIG. 3, with the concavity of arm 28 being reversed from that of arms 26 and 30. The free ends of the arms 26, 28, 30 are tapered to define relatively sharpened tips to assist in penetrating the insulation of the cable. The opposite end of each terminal 18 has a suitable mating configuration, such as the leg 36 which has a transverse concavity as shown. This concavity aids in strengthening the leg 36 in the same way as the arms 26, 28, and 30. The cover 20 includes a plurality of contact receiving recesses 38, here shown as through slots. The recesses 38 each have a stepped configuration which will receive, guide, and restrain the arms of the respective contacts received therein.

Figure 1:
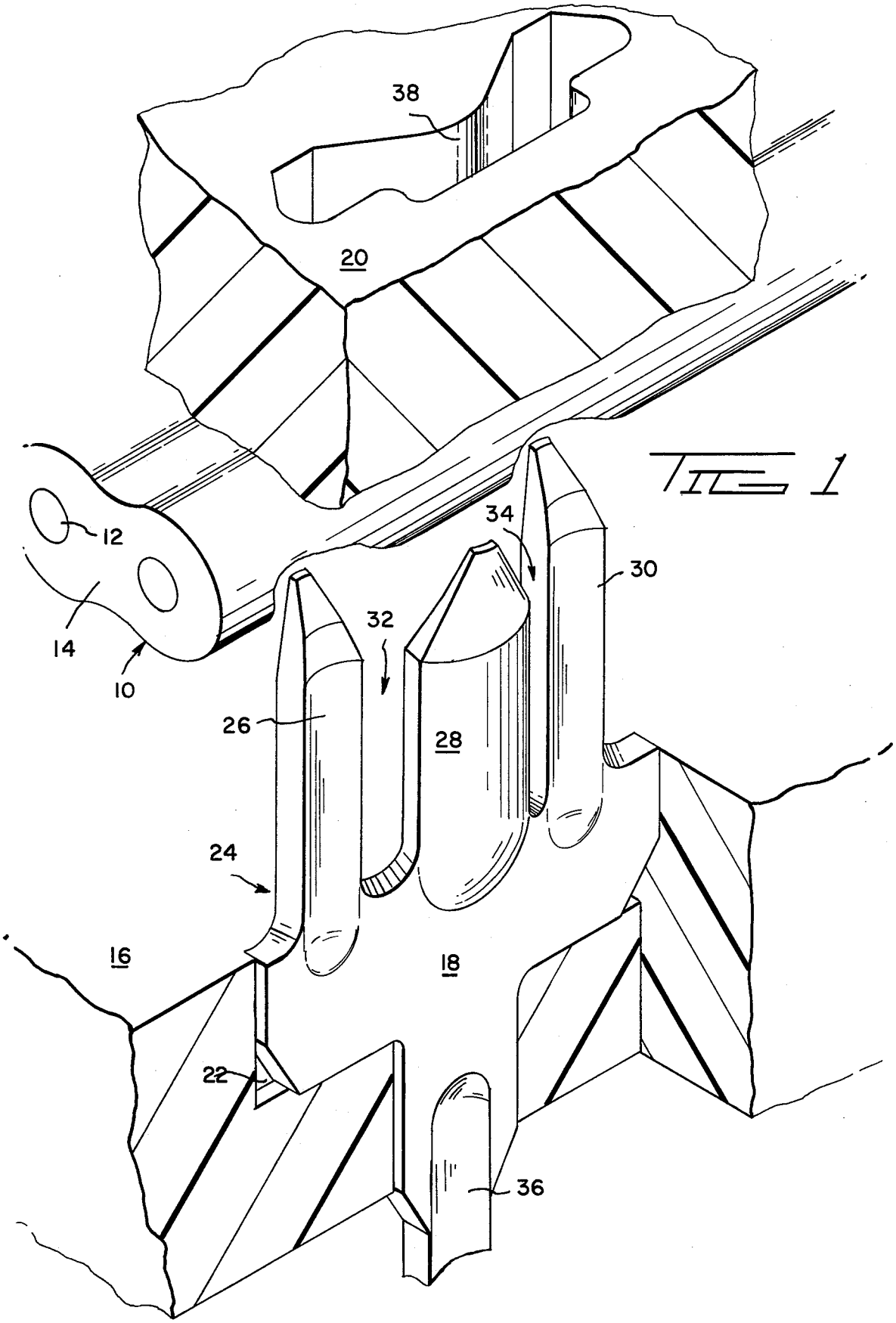
FIG. 1 is an exploded perspective view of a fragment of an electrical connector embodying the present invention, portions of the connector being shown in section.
Figure 2:
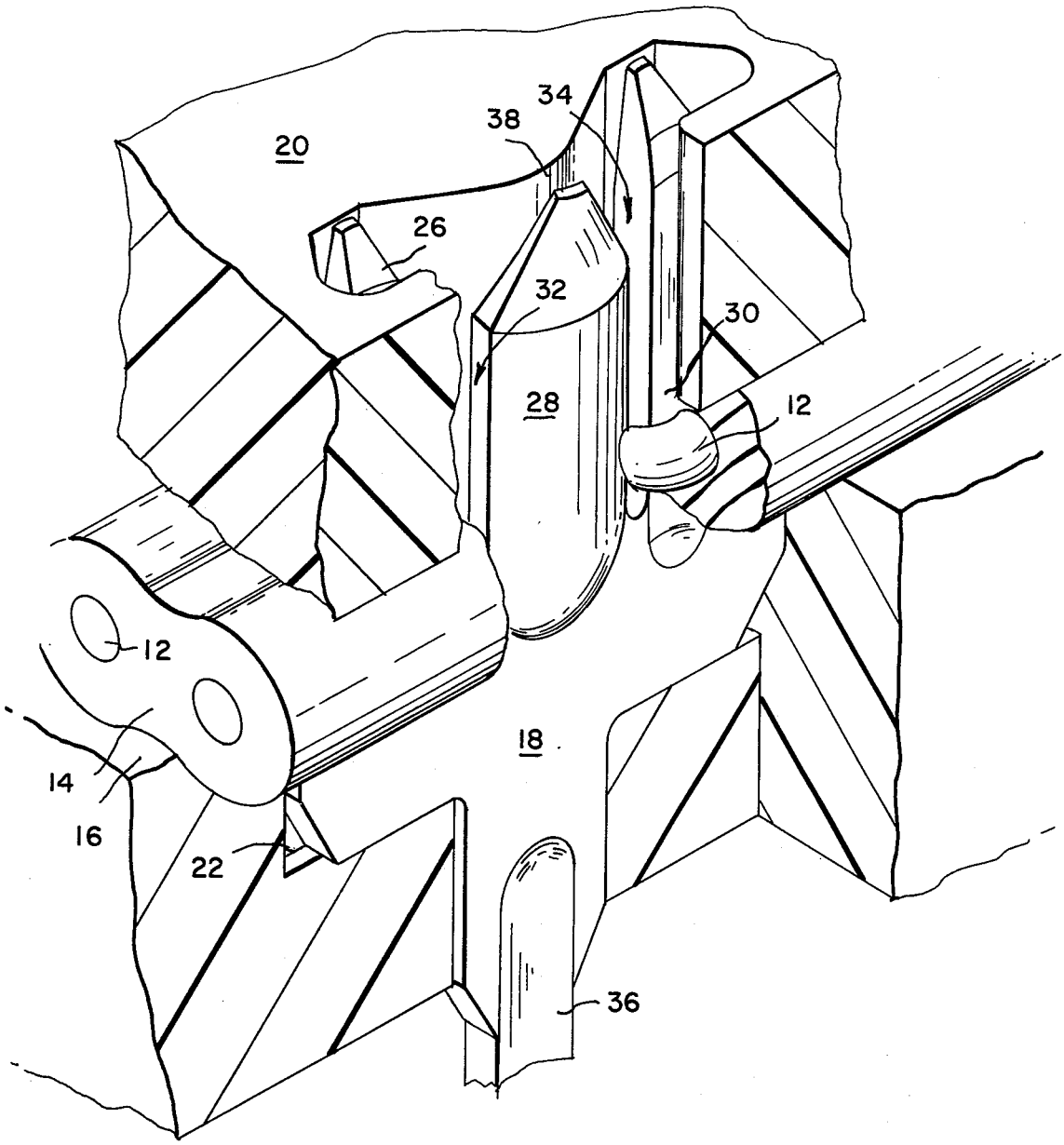
FIG. 2 is a view similar to FIG. 1 showing the conductor fully terminated in the subject terminal.
Figure 4:
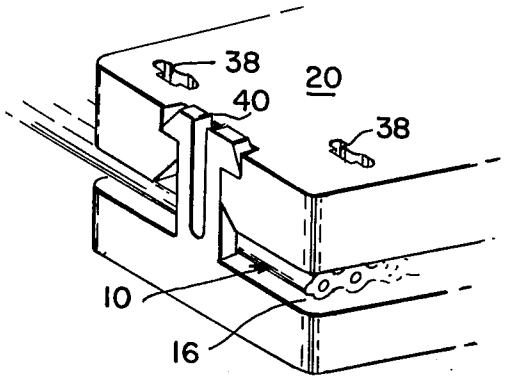
FIG. 4 is a perspective view of an end of the subject connector assembly illustrating a latching means.

The cover 20 and base member 16 are provided with interengaging latching means 40, such as those shown in FIG. 4.

In operation the contacts are loaded into the connector base in conventional fashion. The cable is aligned on the base and pressed into the contact terminals in either a one step or two step operation with or without the cover, respectively, to effect the desired termination. Pressing of the cover against the base in either a one step or two step operation will effect a latching of the cover and the base together. The conductors of the cable will be forced into the tortuous path as shown in FIG. 3. This ensures, in the instance shown, that there will be at least 6 points of contact between the conductor and the respective contact terminal.

Figure 5:
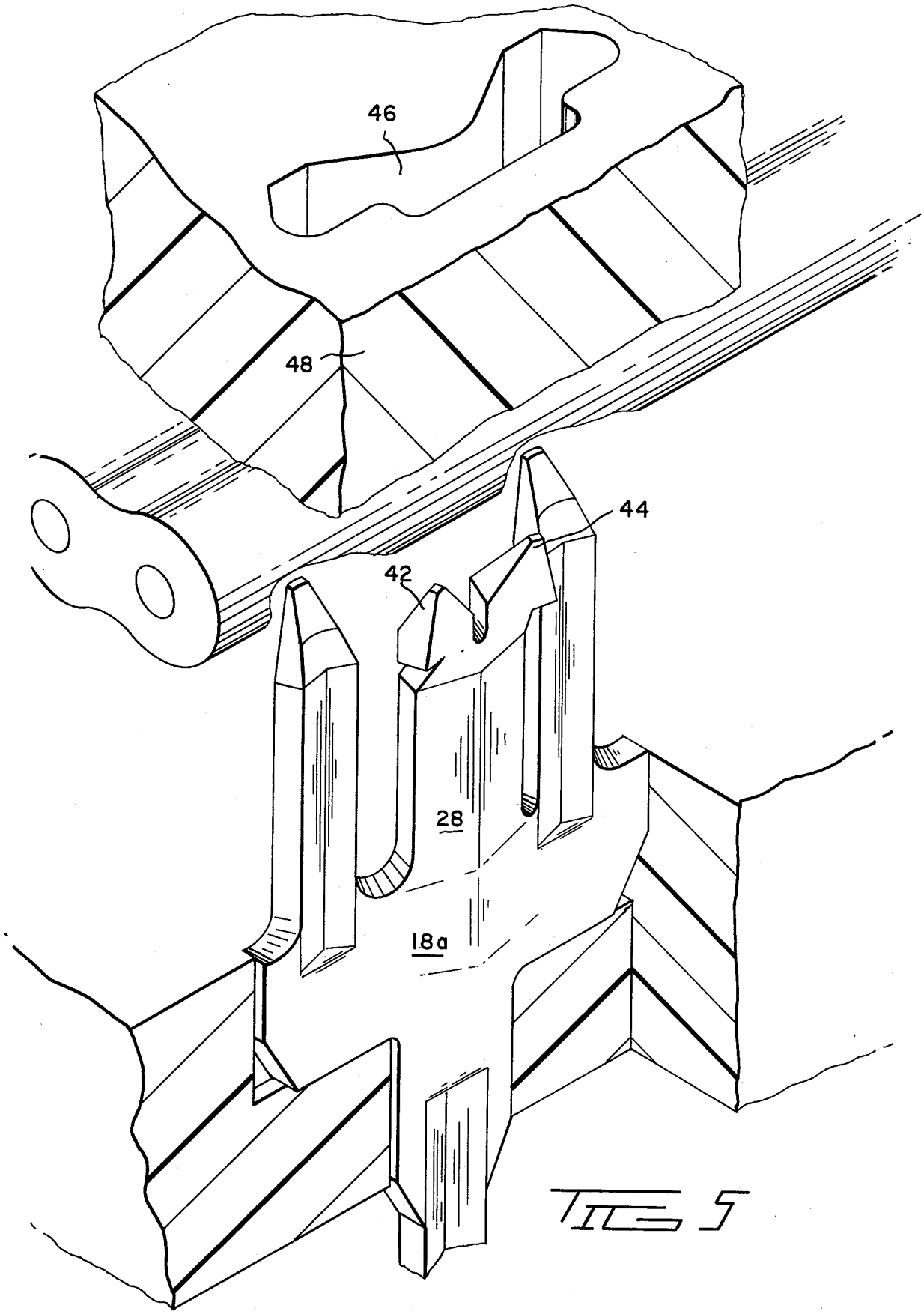
FIG. 5 is a view similar to FIG. 1 showing an alternate embodiment of the subject contact terminal having a latching configuration.
Figure 6:
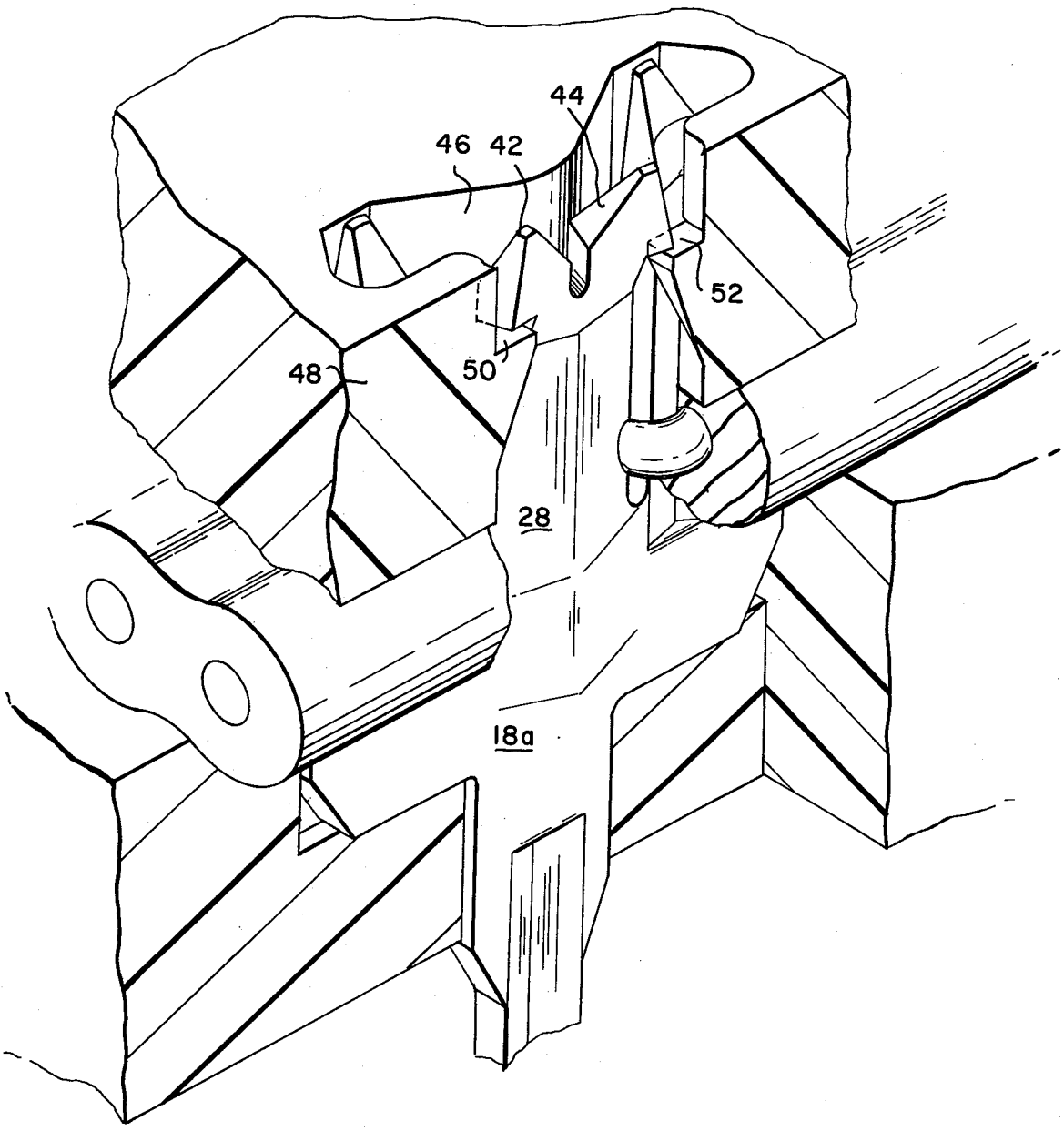
FIG. 6 is a view similar to FIG. 2 showing the alternate embodiment of the subject contact terminal in the latched condition.
Figure 7:
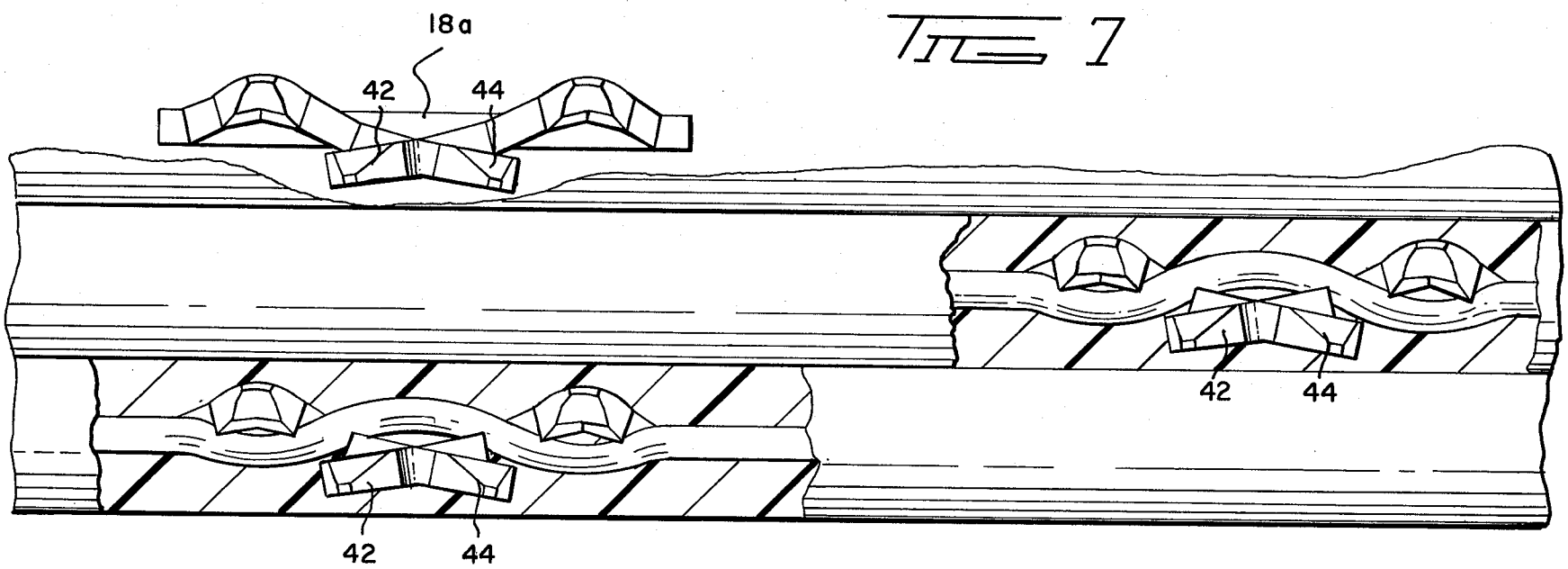
FIG. 7 is a view similar to FIG. 4 showing the alternate embodiment of the subject contact terminal terminating a segment of a multi-conductor flat flexible cable.

The alternate embodiment of the present invention, shown in FIGS. 5 to 7, differs from the previous embodiment in that latching tines 42, 44 are provided on the free end of the central arm 28 of the terminal 18*a*. Likewise the recesses 46 in the cover 48 are modified to include the shoulders 50, 52 which engage with the latching tines 42, 44 of the contact terminals 18*a*. Since this embodiment will provide latching of the cover, by the contacts, across the entire width of the cable, it is possible to dispense with the latching means 40 shown in FIG. 4 in this embodiment.

The present invention may be subject to many modifications and changes without departing from the spirit or essential characteristics thereof. The present embodiments are therefore to be considered in all respects as illustrative and not restrictive of the scope of the invention.

What is claimed is:

1. A contact terminal for effecting insulation displacing engagement with a conductor of a multi-conductor cable in which the conductors are on close centerlines, said terminal comprising:

a flat metal plate body having at least three parallel closely spaced tines extending from one edge, each said tine having a concave transverse profile with the concavity of adjacent tines being oppositely directed, said tines lying substantially in a common plane and defining an insulation displacing slot between adjacent pairs of tines; and a matable portion extending from another edge of said body.

2. A contact terminal according to claim 1 further comprising:

a locking lance extending from said contact body.

3. A contact terminal according to claim 1 wherein: the free ends of said tines are profiled to effect insulation piercing.

4. A contact terminal according to claim 1 wherein: the free end of at least one tine is profiled to form a latch.

5. An electrical connector assembly for terminating multi-conductor cable having close center axis spacing between the conductors of said cable, said connector assembly comprising:

a base having a plurality of contact receiving slots therein;

a plurality of contact terminals each mounted in a respective one of said cavities, each said contact terminal having a flat metal plate body with at least three parallel closely spaced tines extending from a first edge and at least one mating engageable portions extending from another edge, said tines defining therebetween at least two conductor receiving slots, each said tine having a concave configuration with the concavity of adjacent tines being oppositely directed; and a cover having a plurality of contact receiving recesses therein, said recesses having a configuration adopted to guide and restrain the movement of said tines.

6. The connector assembly according to claim 5 further comprising latching means securing said cover on said base.

7. A connector assembly according to claim 5 further comprising:

latching means on the free end of at least one of said tines of said contact terminals, said latching means interengaging with said cover member to clampingly secure the cable between said cover and said base.

8. A connector assembly according to claim 5 further comprising:

interengageable means on said tines and said cover member and comprising laterally outwardly directed free end portions on said tines, said free end portions having shoulders directed towards said base, said recesses in said cover including ledges with which said shoulders engage to clampingly secure the cable between the cover and the base.

* * * * *